US010190384B2

(12) United States Patent
Boyd et al.

(10) Patent No.: US 10,190,384 B2
(45) Date of Patent: Jan. 29, 2019

(54) DRILLING STRIPPING ELEMENT

(71) Applicant: WEATHERFORD TECHNOLOGY HOLDINGS, LLC., Houston, TX (US)

(72) Inventors: Michael Boyd, Nisku (CA); Stephen D. Masters, Nisku (CA); Andrew Barabash, Edmonton (CA)

(73) Assignee: Weatherford Technology Holdings, LLC, Houston, TX (US)

( * ) Notice: Subject to any disclaimer, the term of this patent is extended or adjusted under 35 U.S.C. 154(b) by 92 days.

(21) Appl. No.: 15/301,061

(22) PCT Filed: Jul. 9, 2015

(86) PCT No.: PCT/IB2015/001690
§ 371 (c)(1),
(2) Date: Sep. 30, 2016

(87) PCT Pub. No.: WO2016/207685
PCT Pub. Date: Dec. 29, 2016

(65) Prior Publication Data

US 2018/0135377 A1 May 17, 2018

Related U.S. Application Data

(60) Provisional application No. 62/185,557, filed on Jun. 26, 2015.

(51) Int. Cl.
*E21B 33/08* (2006.01)
*E21B 33/06* (2006.01)
*E21B 33/068* (2006.01)

(52) U.S. Cl.
CPC ..... *E21B 33/085* (2013.01); *E21B 33/06* (2013.01); *E21B 33/068* (2013.01)

(58) Field of Classification Search
CPC ..... E21B 33/06; E21B 33/085
See application file for complete search history.

(56) References Cited

U.S. PATENT DOCUMENTS 3,503,617 A 3/1970 Williams
4,363,357 A 12/1982 Hunter
(Continued)

FOREIGN PATENT DOCUMENTS

CA 2734901 A1 9/2012
WO 9212376 A1 7/1992
WO 98/07956 A1 2/1998

OTHER PUBLICATIONS

European Search Report dated Aug. 24, 2017 for EP Patent Application No. 15888727.3, 10 pages.
(Continued)

*Primary Examiner* — D. Andrews
*Assistant Examiner* — Kristyn A Hall
(74) *Attorney, Agent, or Firm* — Smith IP Services, P.C.

(57) ABSTRACT

A stripping element for rotary flow control diverters used in the oil and gas industry can include a stiffening member formed of a first harder material than a deformable member formed of a second softer material over-molded to the stiffening member. The stiffening member can include apertures that provide for the second softer material of the deformable member to be displaced through the apertures when a pipe of a drill is displaced through the stripping element. The stiffening member can include multiple members that stiffen the deformable member to prevent the deformable member from bending into the stripping element when a pipe of a drill is displaced through the stripping element. The multiple members can be displaced out in a direction away from the pipe of the drill when the pipe of the drill is displaced through the stripping element to prevent the stripping element from being compromised.

10 Claims, 10 Drawing Sheets

(56) References Cited

U.S. PATENT DOCUMENTS

| | | | | |
|---|---|---|---|---|
| 6,109,348 | A | 8/2000 | Caraway | |
| 2010/0213635 | A1 | 8/2010 | Williams et al. | |
| 2012/0118559 | A1* | 5/2012 | Li | E21B 33/085 166/84.3 |
| 2012/0261888 | A1* | 10/2012 | Borden | E21B 33/085 277/562 |
| 2015/0075816 | A1* | 3/2015 | Jacob | E21B 34/14 166/387 |
| 2015/0376970 | A1* | 12/2015 | Hughes | E21B 33/085 166/84.1 |

OTHER PUBLICATIONS

Australian Examination Report dated Nov. 2, 2017 for AU Patent Application No. 2015399537, 3 pages.
International Search Report and Written Opinion dated Feb. 25, 2016 in PCT/IB2015/001690, 9 pages.
Australian Examination Report dated Feb. 19, 2018 for AU Patent Application No. 2015399537, 3 pages.
Canadian Office Action dated Jul. 17, 2017 for CA Patent Application No. 2,943,763, 3 pages.
International Search Report with Written Opinion dated Feb. 25, 2016 for PCT Patent Application No. PCT/IB2015/001690, 9 pages.
Australian Examination Report dated Jun. 27, 2018 for AU Patent Application No. 2015399537, 4 pages.

* cited by examiner

DRILLING STRIPPING ELEMENT

CROSS-REFERENCE TO RELATED APPLICATIONS

This application is a national stage under 35 USC 371 of International Application No. PCT/IB2015/001690, filed on 9 Jul. 2015, which claims the benefit of the filing date of U.S. Provisional Application No. 62/185557, filed on 26 Jun. 2015. The entire disclosures of these prior applications are incorporated herein by this reference.

BACKGROUND

In the oil and gas industry it is conventional to mount a rotating blowout preventer or rotating flow control diverter at a top of a blowout preventer (BOP) stack beneath a drilling floor of a drilling rig while drilling for oil, gas or coal bed methane. Existing rotating flow control diverters serve to seal a pipe that is being moved in and out of a wellbore while allowing the pipe to rotate in the wellbore. Existing rotating flow control diverter may also be used to contain or divert fluids such as drilling mud, produced fluids, and surface injected air or gas into a recovery line.

Existing rotating flow control diverters consist of rubber strippers or sealing elements and an associated hollow shaft that rotates with the drill string within a robust housing. Rotation of the strippers and the associated hollow shaft may be facilitated by a bearing assembly typically having an inner race that rotates with the drill string and an outer race that remains stationary with the housing. The bearing assembly is isolated from fluids and/or gases in the wellbore by seals.

However, existing stripper elements are often compromised or damaged from a tool joint passing through the stripper element arranged with the rotating flow control diverter. Stripping element failure is one manner in which a rotating flow control diverter may encounter mechanical problems. For example, a stripping element may be compromised or damaged causing the stripping element to fail to seal a pipe arranged in a wellbore because a tool joint passing through the stripping element may produce sufficient pressure on the stripping element, and/or cause expansion of the stripping element, to invert and/or tear the stripping element. For example, a tool joint passing through an elastomer arranged on a stripping element metal sub may cause the elastomer to fail by inverting the elastomer or tearing the elastomer. A failure of a stripper element may cause downtime in a drilling operation. Further, it is imperative that the stripper elements are robust and reliable to safeguard workers operating in the vicinity of rotating flow control diverters. It is therefore desirable that a rotating flow controller diverter be designed with components that function in a trouble free manner, and that are as durable as other associated drilling components.

Accordingly, there remains a need in the art for improved stripper elements that reduce or prevent failure of rotating flow control diverters to reduce downtime in drilling operations and safeguard workers operating in the vicinity of the rotating flow control diverters. It is therefore desirable that a rotating flow controller diverter be designed with components that function in a trouble free manner, and that are as durable as other associated drilling components.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items. The drawings are not necessarily to scale. Example embodiments depicted and described are but a few of a number of possible arrangements utilizing the fundamental concepts of this disclosure.

DETAILED DESCRIPTION

In the present disclosure, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

This application describes stripping elements for rotary flow control diverters. Generally, the stripping elements comprise a stiffening member formed of a first harder material than a deformable member formed of a second softer material over-molded or insert molded to the stiffening member. The rotary flow control diverters generally comprises a stationary housing adapted for incorporation into a wellhead and a rotating shaft portion which can have a stripping element bolted there to. The stripping elements can provide for sealing to a tubular structure such as tubing or drill pipe that may be passed through a shaft. For example, the stripping elements may provide for sealing on a drill pipe for isolating a wellbore from the atmosphere.

In at least one embodiment, the stiffening member may comprise one or more apertures arranged in a wall of the stiffening member. The one or more apertures may provide for the second material of the deformable member to be displaced through the one or more apertures when a pipe of a drill, portions of the pipe including a tool joint, a coupling, a junction, etc. connecting lengths of the pipe, is displaced through the stripping element.

Figure 1:
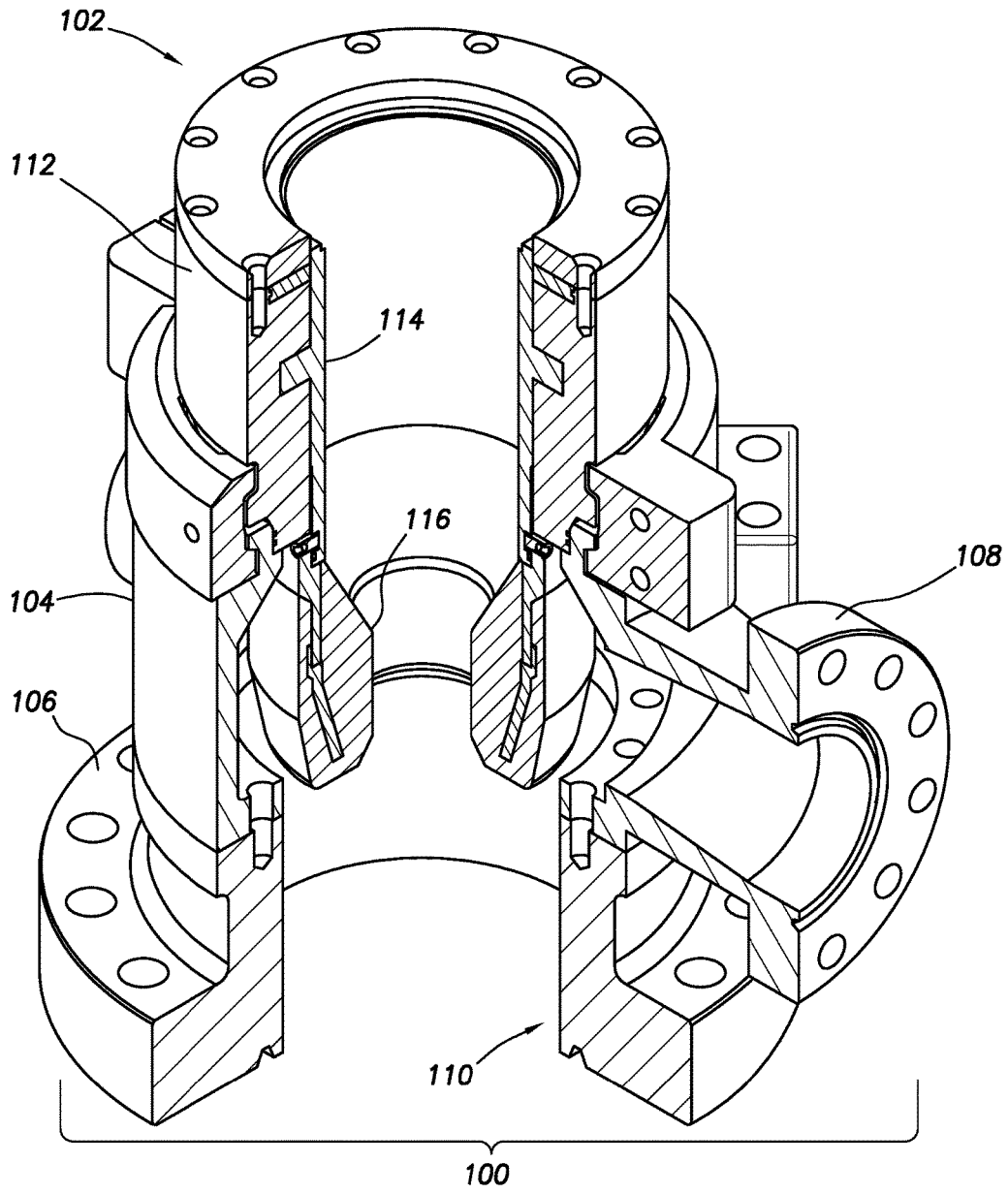
FIG. 1 depicts a vertical three-quarter section view of an illustrative rotary flow control diverter.

In some embodiments, the stiffening member may comprise multiple members arranged around a circumference of a wall of the stiffening member. The multiple members configured such that when in use one or more of the multiple members can be displaced in a direction away from a pipe of a drill, portions of the pipe including a tool joint, a coupling, a junction, etc. connecting lengths of the pipe, being slideably displaced through the stripping element. One or more of the multiple members may comprise at least one aperture arranged in a respective member. In this example where the multiple members may comprise at least one aperture arranged in at least one of the multiple members, the apertures may provide for the second material of the deformable member to be displaced through the apertures when a pipe of a drill, portions of the pipe including a tool joint, a coupling, a junction, etc. connecting lengths of the pipe, is slideably displaced through the stripping element. By virtue of having stripping elements comprising a stiffening member formed of a first harder material than a deformable member formed of a second softer material over-molded or insert molded to the stiffening member, the stripping elements can reduce or prevent failures of rotating flow control diverters, while providing for a pipe of a drill, portions of the pipe including a tool joint, a coupling, a junction, etc. connecting lengths of the pipe, to be slideably displaced through the rotating flow control diverters. FIG. 1 depicts a vertical three-quarter section view 100 of an illustrative rotary flow control diverter 102. FIG. 1 illustrates the rotating flow control diverter 102 can comprise a stationary housing 104. The stationary housing 104 can include a flange connection 106. The flange connection 106 can be adapted to operatively connect with a wellhead or blow out preventer (not shown). In operation for diverting and recovering fluids and gases from the wellbore, the stationary housing 104 can include one or more outlets 108 arranged along a side portion of the stationary housing 104 for the selective discharge of well fluids and gases.

The stationary housing 104 can have a bore 110 for receiving fluid and gas from the wellbore. The rotating flow control diverter 102 can have a sealed bearing assembly 112. The sealed bearing assembly 112 can have an axially rotatable inner tubular shaft 114 disposed therein. The axially rotatable inner tubular shaft 114 can have stripping element assembly 116 coupled to the inner tubular shaft 114. For example, the stripping element assembly 116 can be supported at a downhole end of the inner tubular shaft 114. The axially rotatable inner tubular shaft 114 can include the stripping element assembly 116 to provide for sealing with the drill pipe (not shown).

Figure 2:
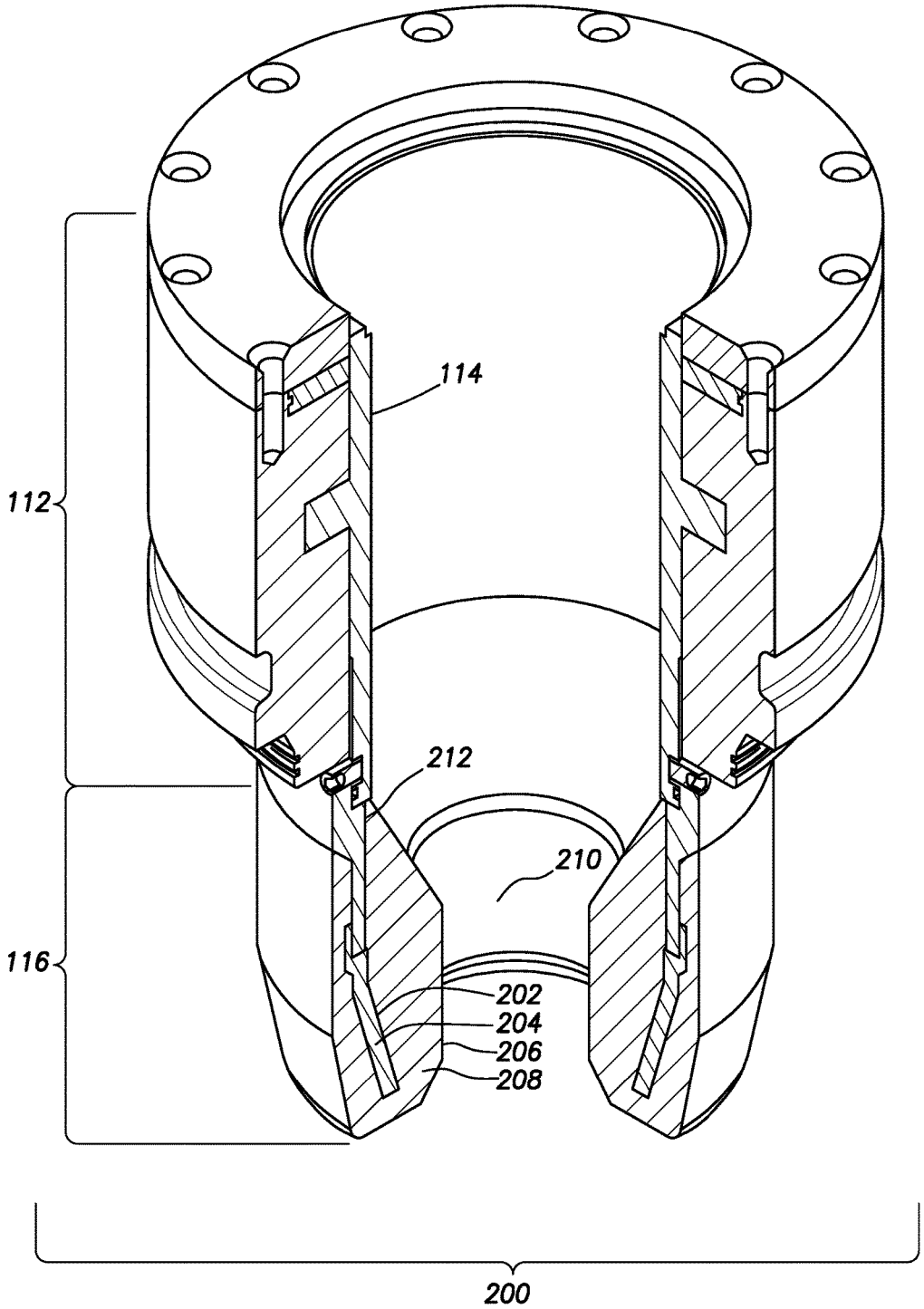
FIG. 2 depicts a vertical three-quarter section view of the illustrative bearing assembly with a stripping element attached to an inner rotating hollow shaft of a bearing assembly of the illustrative rotary flow control diverter illustrated in FIG. 1.

FIG. 2 depicts a vertical three-quarter section view 200 of the illustrative bearing assembly 112 depicted in FIG. 1. As discussed above, the sealed bearing assembly 112 can include the stripping element assembly 116 to provide for sealing with the drill pipe (not shown). FIG. 2 illustrates the stripping element assembly 116 can comprise a stiffening member 202 formed of a first material 204, and a deformable member 206 formed of a second material 208. The second material 208 forming the deformable member 206 can be over-molded onto at least a portion of the stiffening member 202. The second material 208 can have a stiffness less than a stiffness of the first material 204 forming the stiffening member 202. For example, the second material 208 forming the deformable member 206 can have a durometer that is less than a durometer of the first material 204 forming the stiffening member 202 to provide for being displaced by a drill pipe. For example, when at least a portion (e.g., a tool joint, a coupling, a junction, etc.) of a pipe of a drill is slideably displaced through a sealing face 210 of the deformable member 206. In some examples, the second material can comprise an elastomer, a polyurethane, a rubber, etc. The first material forming the stiffening member 202 can have a durometer that is more than the durometer of the first material 204. For example, the first material 204 can have a durometer that is more than a durometer of the first material 204 to provide for stiffening the deformable member 206 to prevent the deformable member 206 from being displaced in toward the sealing face 210 and folding into an inside area of the stripping element assembly 116. For example, the stiffening member 202 can prevent the deformable member 206 bending (e.g., curling, peeling, wrapping, etc.) up into the stripping element assembly 116 when at least a portion (e.g., a tool joint, a coupling, a junction, etc.) of a pipe of a drill is slideably displaced through a sealing face 210 of the deformable member 206.

The stripping element assembly 116 can comprise a cylindrical-shaped retention portion 212. The cylindrical-shaped retention portion 212 can provide for coupling the stripping element assembly 116 to a portion of a rotating flow control diverter. For example, cylindrical-shaped retention portion 212 can provide for coupling the stripping element assembly 116 to the sealed bearing assembly 112 and/or the axially rotatable inner tubular shaft 114, and the sealed bearing assembly 112 can couple to the stationary housing 104 of the flow control diverter 102. The cylindrical-shaped retention portion 212 can comprise metal, plastic, ceramic, composite, etc. Of these, at least metal and ceramic are examples of non-elastomeric materials.

Figure 3:
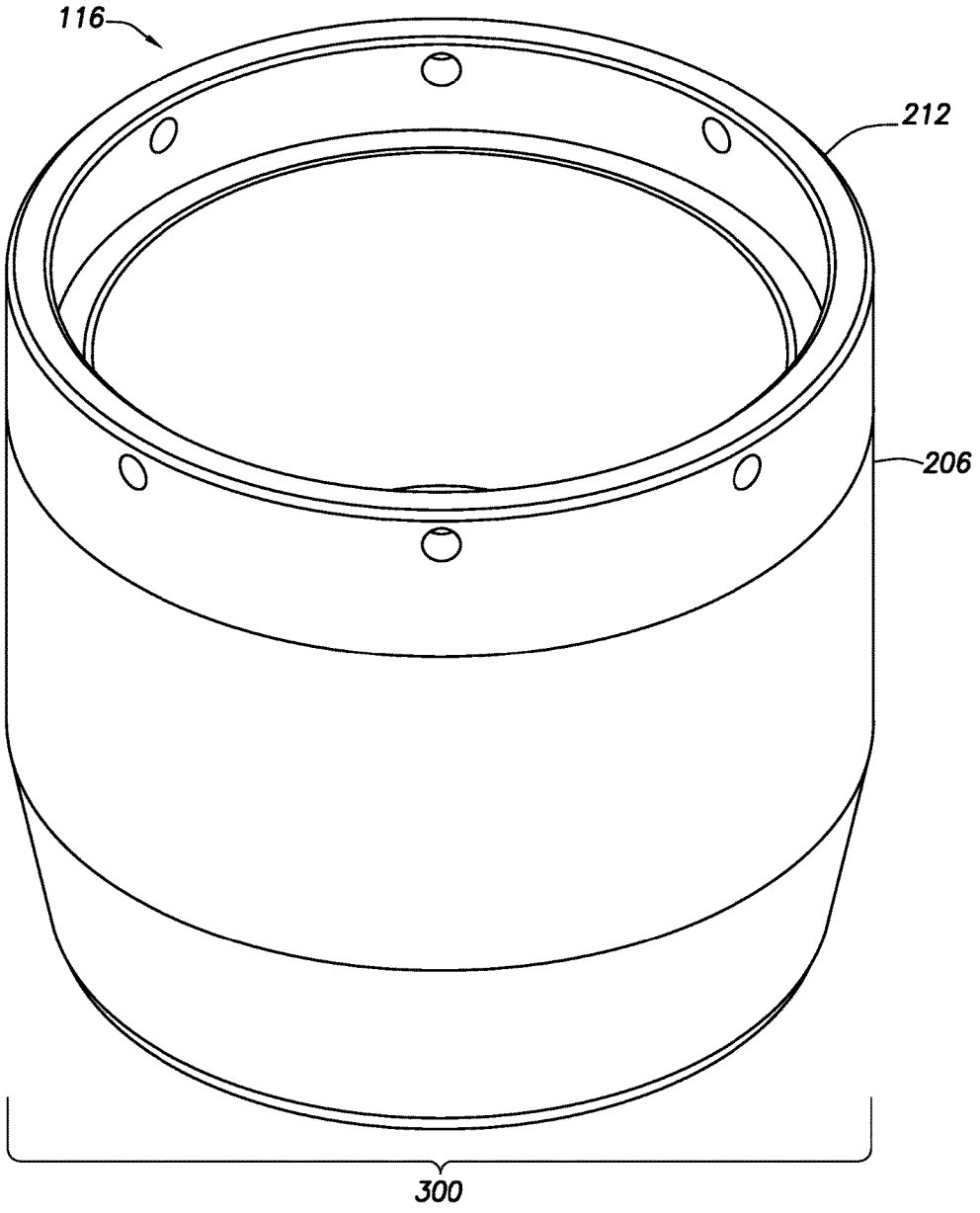
FIG. 3 depicts a perspective view of an illustrative stripping element for a rotary flow control diverter.

FIG. 3 depicts a perspective view 300 of the illustrative stripping element assembly 116 for the illustrative rotary flow control diverter 102 illustrated in FIG. 1. FIG. 3 depicts the stripping element assembly 116 can comprise the deformable member 206 formed 206 of the second material 208 can be over-molded onto at least a portion of the stiffening member 202 (described in more detail below). For example, the stiffening member 202 can be formed of a single unit of the first material 204 and the deformable member 206 can be formed of a single unit of material that is over-molded onto the stiffening member 202.

Figure 4:
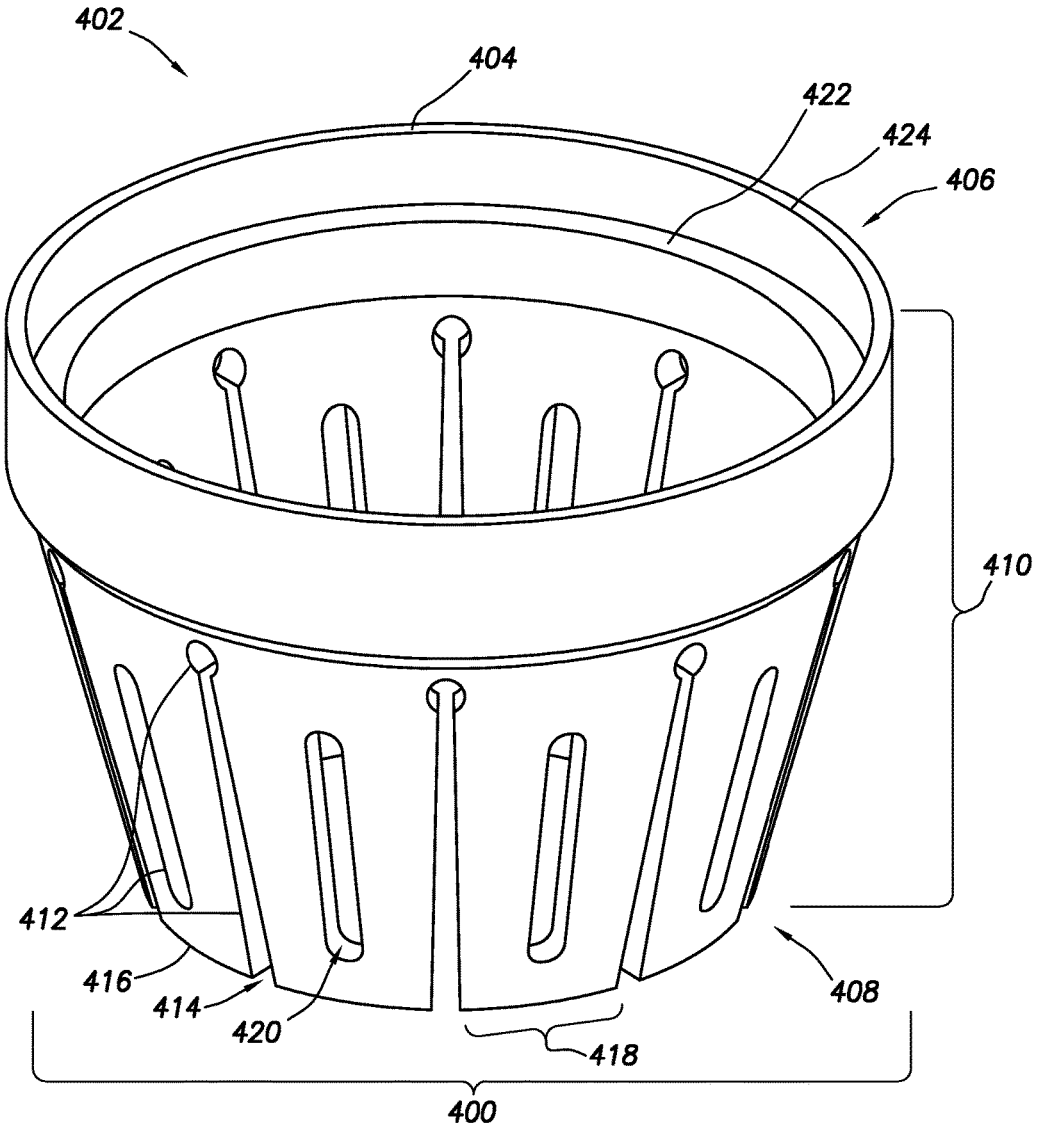
FIG. 4 depicts a perspective view of an illustrative stiffening member.

FIG. 4 depicts a perspective view 400 of an illustrative stiffening member 402, the illustrative stiffening member 402 can be an example of stiffening member 202 for the illustrative stripping element assembly 116 illustrated in FIG. 1. The stiffening member 402 can comprise a hollow cylinder having a rim 404 at a top 406 opposite a bottom 408. A wall 410 can be arranged between the top and the bottom of the hollow cylinder, and one or more apertures 412(1), 412(2), 412(N) can be arranged in the wall 410. The one or more apertures 412(1), 412(2), 412(N) can provide for the second material 208 of the deformable member 206 to be displaced by a portion of a pipe of a drill through the one or more apertures 412(1), 412(2), 412(N) of the stiffening member 402. For example, the one or more apertures 412(1), 412(2), 412(N) can provide for the second material 208 of the deformable member 206 to move freely through the one or more apertures 412(1), 412(2), 412(N) as the portion of the pipe of the drill passes through the stripping element assembly 116. The portion of the pipe passing through the stripping element assembly 116 can be, for example, a tool joint, a coupling, a junction, etc. having a larger outside diameter than an outside diameter of the pipe. Because a tool joint, a coupling, a junction, etc. connecting lengths of pipe has a larger outside diameter than an outside diameter of the lengths of pipe, the tool joint, coupling, junction, etc. is offset from the lengths of pipe. Thus, the one or more apertures 412(1), 412(2), 412(N) can provide for the second material 208 of the deformable member 206 to move freely through the one or more apertures 412(1), 412(2), 412(N) as the increased outside diameter of a tool joint, a coupling, a junction, etc. passes through the stripping element assembly 116. While the stiffening member 402 can be illustrated as comprising a single unit of urethane (e.g., polyurethane), the stiffening member 402 can comprise more than a single unit of urethane. For example, a top portion of the stiffening member 402 can be formed of a first urethane and a bottom portion of the stiffening member 402 can be formed of a second urethane or a second different polymer. The one or more apertures 412(1), 412(2), 412(N) can comprise multiple slits 414. For example, the one or more apertures 412(1), 412(2), 412(N) can comprise multiple slits 414 arranged around a circumference 416 of the wall 410. The multiple slits 414 can be arranged around the circumference 416 of the wall 410 can be formed in a lower end of the hollow cylinder and extend through the bottom 408 of the hollow cylinder. One or more of the multiple slits 414 can include a cylindrical shaped opening arranged in the top of the multiple slits 414. In one example, the multiple slits 414 can be arranged uniformly around the circumference 416 of the wall 410 of the hollow cylinder. When at least a portion of the pipe of the drill is slideably displaced through deformable member 206, the second material 208 of the deformable member 206 is displaced by the portion of the pipe of the drill through the multiple slits 414 of the stiffening member 402.

The stiffening member 402 can comprise multiple members 418 arranged around the circumference 416 of the wall 410 of the hollow cylinder. For example, multiple members 418 can be arranged between the multiple slits 414. The multiple members 418 can be displaced in a direction away from a pipe of a drill when at least a portion (e.g., a tool joint, a coupling, a junction, etc.) of the pipe of the drill is slideably displaced through the sealing face 210 of the deformable member 206. The multiple members 418 can strengthen or fortify the deformable member 206. For example, the multiple members 418 can increase the stiffness of the deformable member 206 and prevent the deformable member 206 from bending (e.g., curling, peeling, wrapping, etc.) into the stripping element assembly 116 when at least a portion (e.g., a tool joint, a coupling, a junction, etc.) of a pipe of a drill is slideably displaced through a sealing face 210 of the deformable member 206. Moreover, the multiple members 418 can prevent the deformable member 206 from being compromised (e.g., broken apart, pulled apart, torn, ripped, etc.) when at least a portion of the pipe of the drill is slideably displaced through the sealing face 210 of the deformable member 206. Because the multiple members 418 can be displaced in a direction away from the pipe of the drill being slideably displaced through the stripping element assembly 116 and increase the stiffness of the deformable member 206, the multiple members 418 provide for the deformable member 206 to seal to the pipe, while also provide for preventing the deformable member 206 from bending into the stripping element assembly 116 when at least a portion of the pipe of the drill is slideably displaced through the stripping element assembly 116. Again, the portion of the pipe passing through the stripping element assembly 116 can be, for example, a tool joint, a coupling, a junction, etc. having a larger outside diameter than an outside diameter of the pipe. Because a tool joint, a coupling, a junction, etc. connecting lengths of pipe has a larger outside diameter than an outside diameter of the lengths of pipe, the tool joint, coupling, junction, etc. is offset from the lengths of pipe. Thus, the multiple members 418 can be displaced in a direction away from the pipe of the drill as the increased outside diameter of a tool joint, a coupling, a junction, etc. passes through the stripping element assembly 116. At least one aperture 420 can be arranged in at least one of the multiple members 418. For example, an elongated opening can be arranged vertically in each of the multiple members 418. The aperture(s) 420 arranged in the multiple members 418 can provide for the second material 208 of the deformable member 206 to be displaced through the aperture(s) when at least a portion of the pipe of the drill is slideably displaced through the sealing face 210 of the deformable member 206. Because the one or more apertures 412(1), 412(2), 412(N) arranged in the wall 410, and each of the apertures 420 arranged in the multiple members 418, provide for the second material 208 forming the deformable member 206 to move freely through the apertures, the deformable member 206 can seal to the pipe, and can be displaced by a portion of the pipe of the drill when at least the portion of the pipe of the drill is slideably displaced through the stripping element assembly 116 without being compromised.

The stiffening member 402 can comprise an upper land 422 and shoulder backing ring 424 arranged proximate to the top 406 of the hollow cylinder. The cylindrical-shaped retention portion 212 can rest on the upper land 422 and shoulder backing ring 424. The cylindrical-shaped retention portion 212 can press-fit, snap-fit, interference-fit, etc. with the upper land 422 and shoulder backing ring 424. Subsequent to the cylindrical-shaped retention portion 212 being arranged to rest on the upper land 422 and shoulder backing ring 424, the deformable member 206 formed of the second material 208 can be over-molded onto the stiffening member 402 and the cylindrical-shaped retention portion 212.

Figure 5:
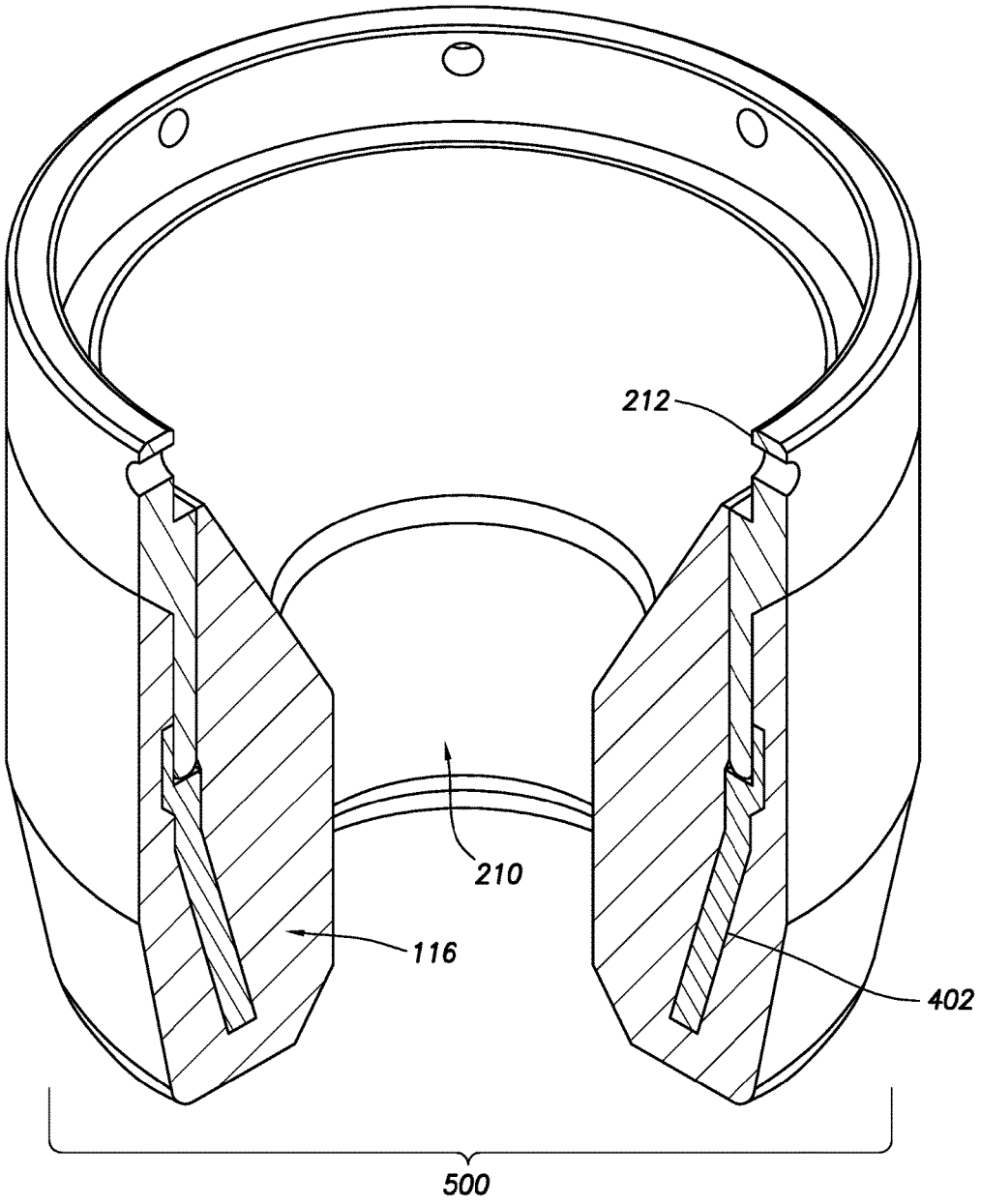
FIG. 5 depicts a vertical three-quarter section view of the illustrative stripping element illustrated in FIG. 3 with the illustrative stiffening member within an illustrative deformable member attached to a cylindrical-shaped retention portion of the stripping element assembly.

FIG. 5 depicts a vertical three-quarter section view 500 of the illustrative stripping element 116 illustrated in FIG. 3 with the illustrative stiffening member 402 within the illustrative deformable member 206 attached to the cylindrical-shaped retention portion 212 of the stripping element assembly 116. For example, FIG. 5 illustrates the stiffening member 402 fully encased within the deformable member 206 and the sealing face 210 of the deformable member 206 that can seal on a drill pipe.

Figure 6:
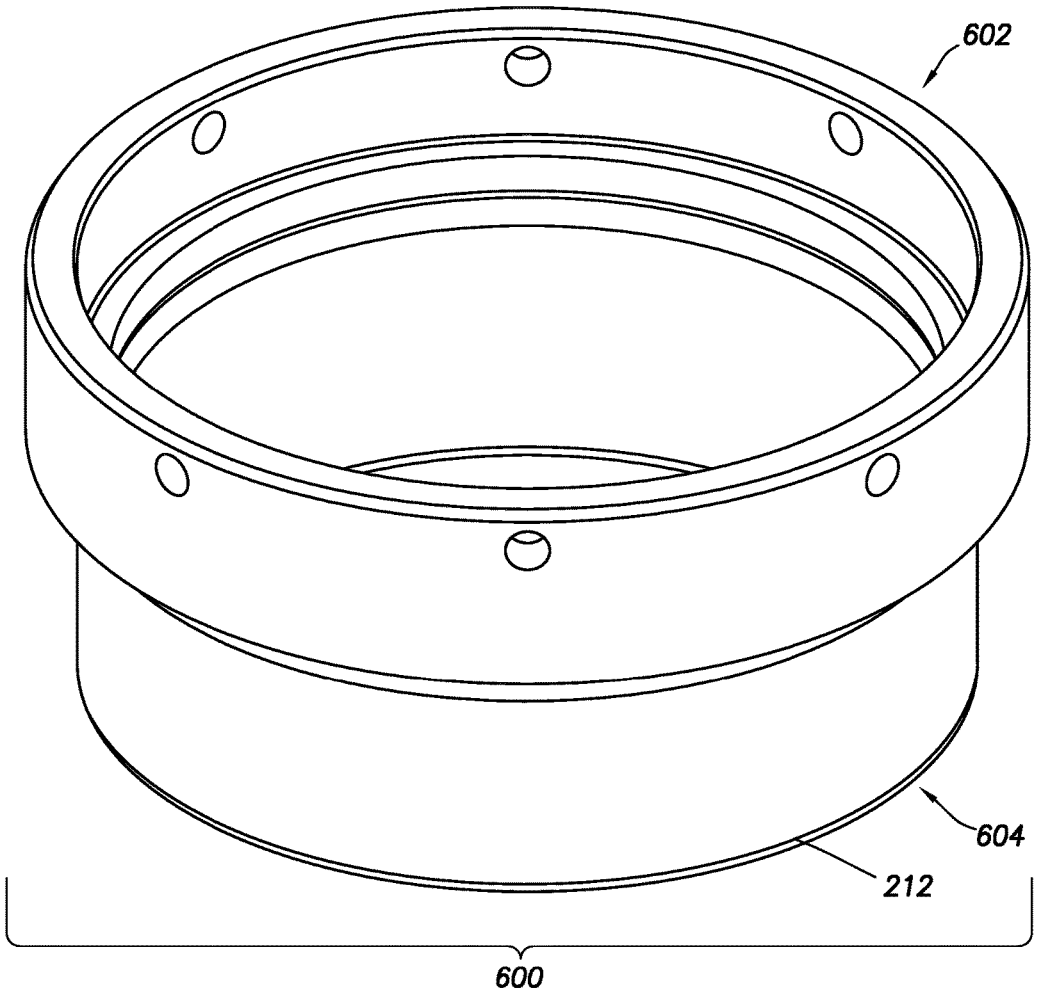
FIG. 6 depicts a perspective view of an illustrative cylindrical-shaped retention portion.

FIG. 6 depicts a perspective view 600 of an illustrative cylindrical-shaped retention portion 212. As discussed above, the cylindrical-shaped retention portion 212 can provide for coupling the stripping element assembly 116 to a portion of a rotating flow control diverter. For example, cylindrical-shaped retention portion 212 can provide for coupling the stripping element assembly 116 to the sealed bearing assembly 112 and/or the axially rotatable inner tubular shaft 114, and the sealed bearing assembly 112 can couple to the stationary housing 104 of the flow control diverter 102. The cylindrical-shaped retention portion 212 can comprises metal, plastic, ceramic, composite etc. The cylindrical-shaped retention portion 212 can have a top 602 opposite a bottom 604. A top portion of the deformable member 206 can be over-molded onto the bottom 604 of the cylindrical-shaped retention portion 212.

Illustrative Processes

FIGS. 7, 8, 9 and 10 illustrate example processes for making and using an illustrative stripping element for a rotary flow control diverter.

The order in which the operations are described in each example flow diagram or process is not intended to be construed as a limitation, and any number of the described operations can be combined in any order and/or in parallel to implement each process. The description of the various processes can include certain transitional language and directional language, such as "then," "next," "thereafter," "subsequently," "returning to," "continuing to," "proceeding to," etc. These words, and other similar words, are simply intended to guide the reader through the graphical illustrations of the processes and are not intended to limit the order in which the process steps depicted in the illustrations can be performed.

Additionally, one or more of the various process steps depicted in FIG. 7, FIG. 8, FIG. 9, and FIG. 10 can be performed at a manufacturing facility, a fabrication facility, a casting facility, a molding facility, a shop, a plant, in the field, at a drilling site, on a drill, etc.

Figure 7:
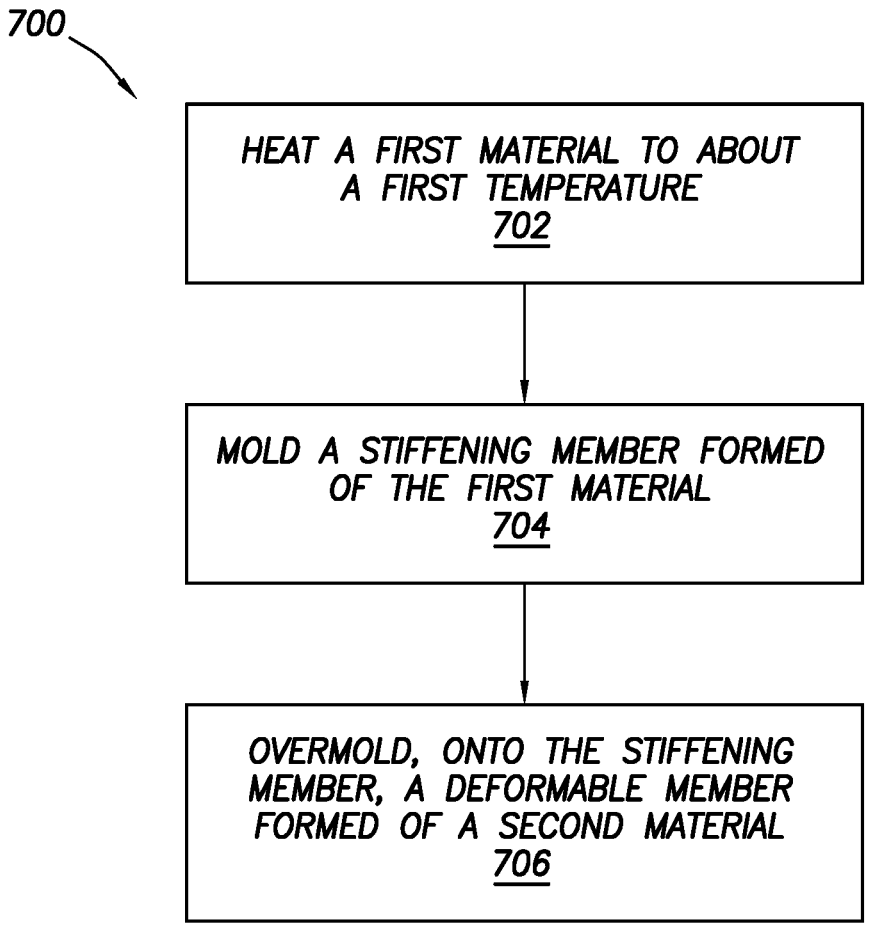
FIG. 7 is a flow diagram that illustrates an example process for making an illustrative stripping element for a rotary flow control diverter.

FIG. 7 is a flow diagram that illustrates an example process 700 for making an illustrative stripping element for a rotary flow control diverter. At block 702, a first material is heated to a first temperature.

At block 704, a stiffening member is molded from the first material.

At block 706, a deformable member formed of a second material is overmolded onto the stiffening member.

Figure 8:
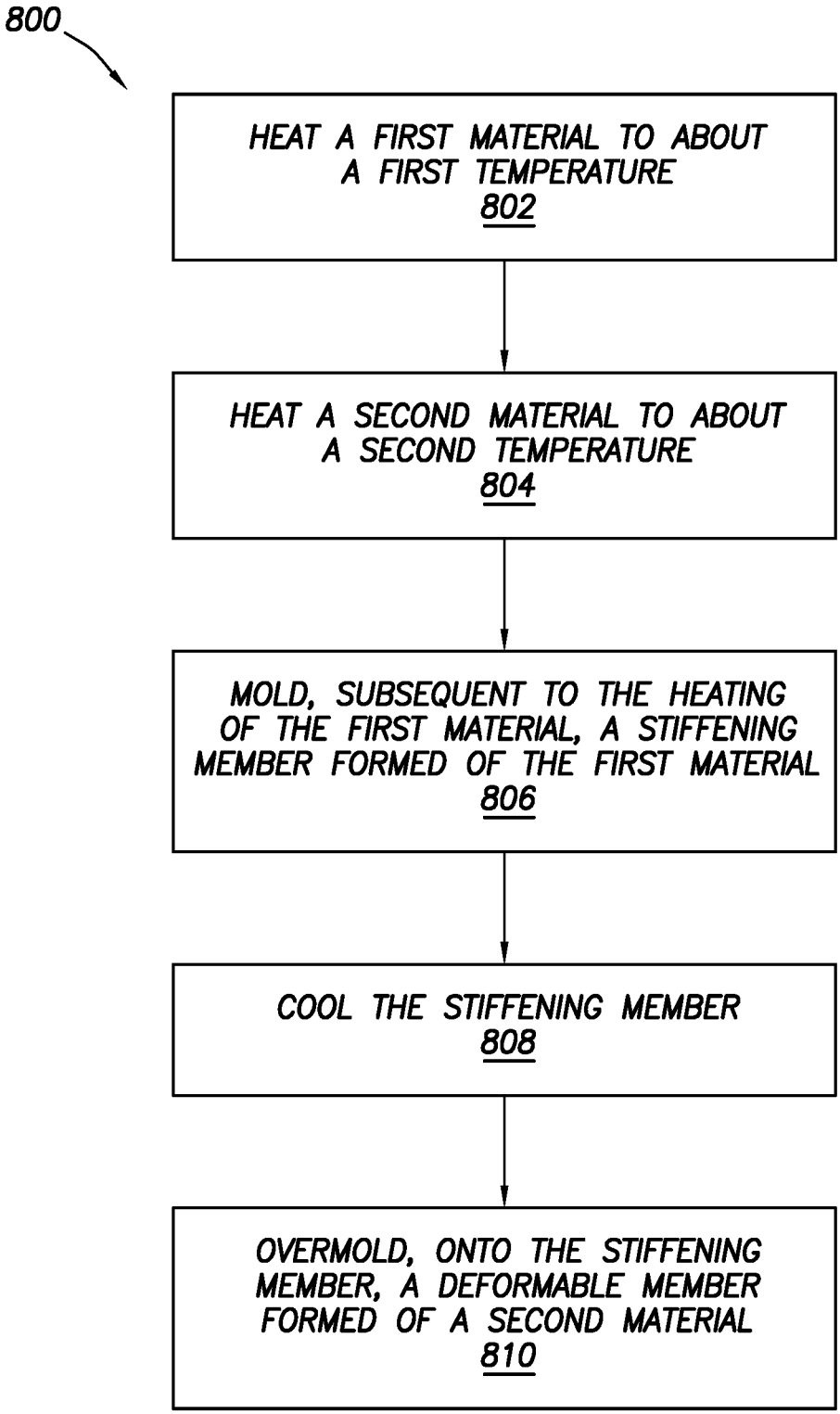
FIG. 8 is a flow diagram that illustrates an example process for making an illustrative stripping element for a rotary flow control diverter.

FIG. 8 is a flow diagram that illustrates an example process 800 for making an illustrative stripping element for a rotary flow control diverter. At block 802, a first material is heated to a first temperature.

At block 804, a second material is heated to a second temperature. In some examples the second temperature is lower than the first temperature.

At block 806, a stiffening member is molded from the first material.

At block 808, the stiffening member is cooled or allowed to cool from the heated state. In some examples, the stiffening member is cooled or allowed to cool to the second temperature. In some examples, the stiffening member is cooled or allowed to cool to a temperature cooler than the second temperature.

At block 810, a deformable member formed of the second material is overmolded onto the stiffening member.

Figure 9:
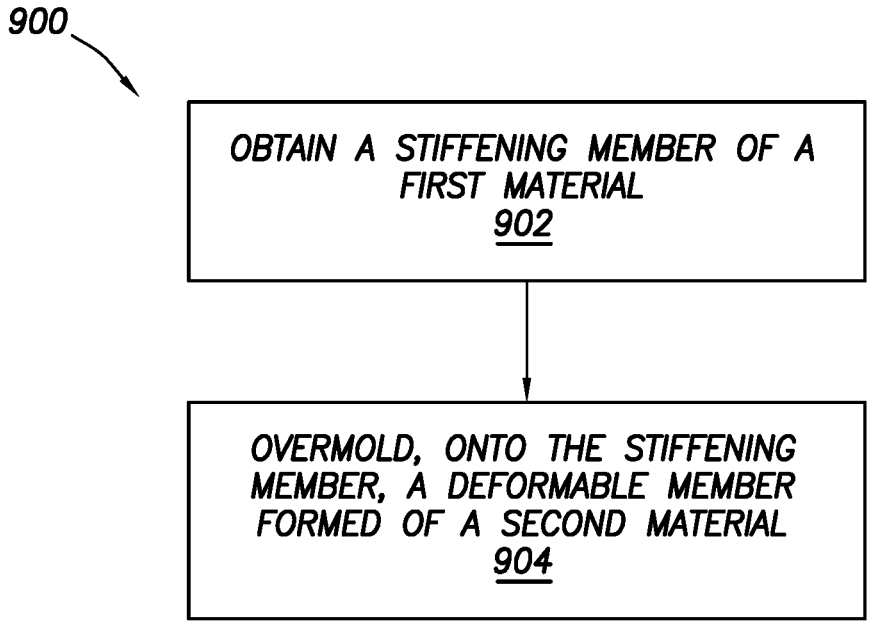
FIG. 9 is a flow diagram that illustrates an example process for making an illustrative stripping element for a rotary flow control diverter.

FIG. 9 is a flow diagram that illustrates an example process 900 for making an illustrative stripping element for a rotary flow control diverter. At block 902, a stiffening member is obtained. For example, a stiffening member can be obtained from an inventory, a stock, a warehouse, etc. Block 902, can include obtaining a cylindrical-shaped retention portion and arranging the cylindrical-shaped retention portion with the stiffening member. For example, the cylindrical-shaped retention portion can rest on an upper land and shoulder backing ring of the stiffening member. The cylindrical-shaped retention portion can press-fit, snap-fit, interference-fit, etc. with the upper land and shoulder backing ring.

At block 906, a deformable member formed of a second material is overmolded onto the stiffening member. Block 906 can include overmolding the deformable member formed of the second material onto the stiffening member and the cylindrical-shaped retention portion.

Figure 10:
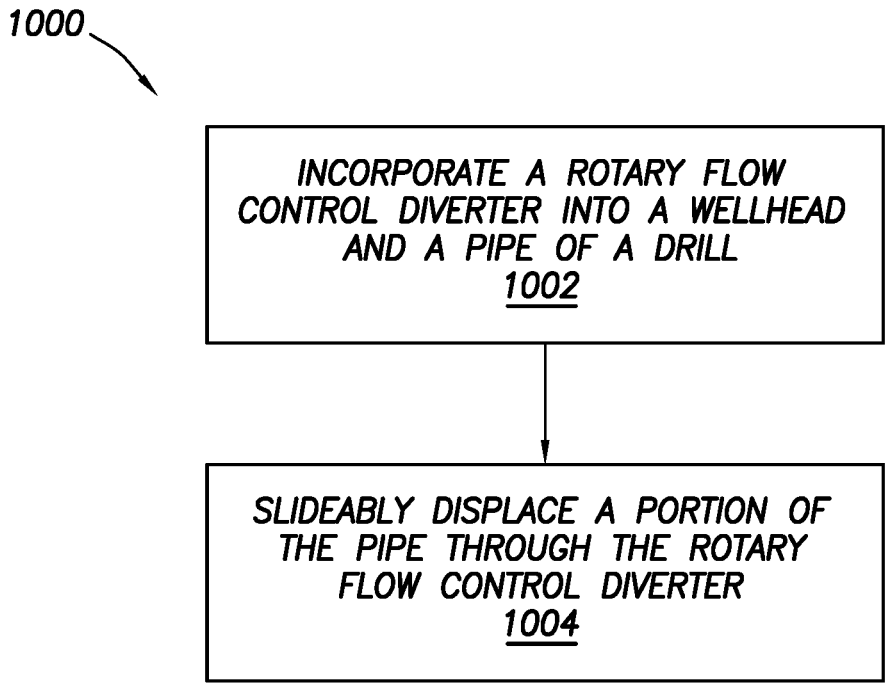
FIG. 10 is a flow diagram that illustrates an example process for using an illustrative stripping element for a rotary flow control diverter.

FIG. 10 is a flow diagram that illustrates an example process 1000 for using an illustrative stripping element for a rotary flow control diverter. At block 1002, a rotary flow control diverter comprising a stripping element assembly is incorporated into a wellhead and a pipe of a drill.

At block 1004, at least a portion of the pipe of the drill is slideably displaced through the rotary flow control diverter. For example, at least a portion of the pipe of the drill is slideably displaced through the stripping element assembly arranged in the rotary flow control diverter.

Example Clauses

A. A stripping element assembly comprising: an stiffening member formed of a first material, the stiffening member comprising: a hollow cylinder having a top opposite a bottom; a wall arranged between the top and the bottom; and one or more apertures arranged in the wall; and a deformable member formed of a second material, the second material forming the deformable member overmolded onto at least a portion of the stiffening member and having a stiffness less than a stiffness of the first material forming the stiffening member, the deformable member comprising: a top opposite a bottom; and a sealing face arranged on an inside portion of the bottom of the deformable member for slideably sealing with a pipe of a drill; and wherein when at least a portion of the pipe of the drill is slideably displaced through the sealing face of the deformable member, the second material of the deformable member is displaced by the portion of the pipe of the drill through the one or more apertures of the stiffening member.

B. A stripping element assembly as clause A recites, further comprising a cylindrical-shaped retention portion for coupling the stripping element to a portion of a rotating flow control diverter, the cylindrical-shaped retention portion having a top opposite a bottom, the top of the deformable member being overmolded onto the bottom of a cylindrical-shaped retention portion.

C. A stripping element assembly as clause B recites, wherein the cylindrical-shaped retention portion comprises one or more apertures arranged in a wall arranged between the top and the bottom of the cylindrical-shaped retention portion, and wherein when at least a portion of the pipe of the drill is slideably displaced through the sealing face of the deformable member, the second material of the deformable member is displaced by the portion of the pipe of the drill through the one or more apertures of the cylindrical-shaped retention portion.

D. A stripping element assembly as clause B recites, wherein the cylindrical-shaped retention portion comprises metal, plastic, ceramic, or composite.

E. A stripping element assembly as any one or combination of clauses A-D recites, wherein the first material and/or the second material comprises an elastomer.

F. A stripping element assembly as any one or combination of clauses A-E recites, wherein the first material and/or the second material comprises polyurethane.

G. A stripping element assembly as any one or combination of clauses A-D recites, wherein the first material and/or the second material comprises natural rubber.

H. A stripping element assembly as any one or combination of clauses A-G recites, wherein at least one of the one or more apertures of the stiffening member comprises a vertical opening arranged in the wall of the stiffening member.

I. A stripping element assembly comprising: an stiffening member formed of a first material, the stiffening member comprising: a hollow cylinder having a top opposite a bottom; a wall arranged between the top and the bottom; multiple slits arranged around a circumference of the wall; and a deformable member formed of a second material, the second material forming the deformable member overmolded onto at least a portion of the stiffening member and having a stiffness less than a stiffness of the first material forming the stiffening member, the deformable member comprising: a top opposite a bottom; and a sealing surface arranged on an inside circumference of the bottom of the deformable member for slideably sealing with a pipe of a drill; and wherein when at least a portion of the pipe of the drill is slideably displaced through the sealing surface of the deformable member, the second material of the deformable member is displaced by the portion of the pipe of the drill through the multiple slits of the stiffening member.

J. A stripping element assembly as clause I recites, wherein at least one of the multiple slits arranged around the circumference of the wall are formed in a lower end of the hollow cylinder and extend through the bottom of the hollow cylinder.

K. A stripping element assembly as clause I recites, wherein the multiple slits are arranged uniformly around the circumference of the wall of the hollow cylinder.

L. A stripping element assembly as any one or combination of clauses I-K recites, further comprising multiple members arranged around the circumference of the wall of the hollow cylinder, the multiple members arranged between the multiple slits, and wherein when at least a portion of the pipe of the drill is slideably displaced through the sealing surface of the deformable member, the multiple members are displaced in a direction away from the pipe of the drill.

M. A stripping element assembly as clause L recites, further comprising at least one aperture arranged in at least one of the multiple members, and wherein when at least a portion of the pipe of the drill is slideably displaced through the sealing surface of the deformable member, the second material of the deformable member is displaced by the portion of the pipe of the drill through the at least one aperture arranged in the at least one of the multiple members.

N. A method comprising: heating a first material to about a first temperature; heating a second material to about a second temperature; molding, subsequent to the heating of the first material, a stiffening member formed of the first material; cooling the stiffening member formed of the first material; and overmolding onto the stiffening member formed of the first material, subsequent to the cooling of the stiffening member formed of the first material, a deformable member formed of a second material; wherein the stiffening member formed of the first material comprises: a hollow cylinder having a top opposite a bottom; a wall arranged between the top and the bottom; and one or more apertures arranged in the wall, wherein when at least a portion of a pipe of a drill is slideably displaced through the deformable member, the second material of the deformable member is displaceable by the portion of the pipe of the drill through the one or more apertures of the stiffening member.

O. A method as clause N recites, further comprising arranging the stiffening member formed of the first material with a cylindrical-shaped retention portion subsequent to the cooling of the stiffening member formed of the first material, and prior to overmolding the deformable member formed of the second material.

P. A method as either clause N or O recites, further comprising overmolding onto the stiffening member formed of the first material and onto the cylindrical-shaped retention portion, subsequent to the cooling of the stiffening member formed of the first material, the deformable member formed of the second material.

Q. A method as any one or a combination of clauses N-P recites, wherein the cylindrical-shaped retention portion comprises metal, plastic, ceramic, or composite.

R. A method as any one or a combination of clauses N-Q recites, wherein the first material and/or the second material comprises an elastomer.

S. A method as any one or a combination of clauses N-R recites, wherein the first material and/or the second material comprises polyurethane.

T. A method as any one or a combination of clauses N-Q recites, wherein the first material and/or the second material comprises natural rubber.

U. A method comprising: heating a first material to about a first temperature; molding, subsequent to the heating of the first material, a stiffening member formed of the first material; overmolding onto the stiffening member formed of the first material, subsequent to the cooling of the stiffening member formed of the first material, a deformable member formed of a second material.

V. A method as clause U recites, further comprising at least one of: heating a second material to about a second temperature; and/or cooling the stiffening member formed of the first material.

W. A method as either clause U or V recites, wherein the stiffening member formed of the first material comprises: a hollow cylinder having a top opposite a bottom; a wall arranged between the top and the bottom; and one or more apertures arranged in the wall, wherein when at least a portion of a pipe of a drill is slideably displaced through the deformable member, the second material of the deformable member is displaceable by the portion of the pipe of the drill through the one or more apertures of the stiffening member.

X. A method as any one or a combination of clauses U-W recites, further comprising arranging the stiffening member formed of the first material with a cylindrical-shaped retention portion prior to overmolding the deformable member formed of the second material.

Y. A method as any one or a combination of clauses U-X recites, further comprising arranging the stiffening member formed of the first material with a cylindrical-shaped retention portion subsequent to the cooling of the stiffening member formed of the first material, and prior to overmolding the deformable member formed of the second material.

Z. A method as any one or a combination of clauses U-Y recites, further comprising overmolding onto the stiffening member formed of the first material and onto the cylindrical-shaped retention portion, subsequent to the cooling of the stiffening member formed of the first material, the deformable member formed of the second material.

AA. A method as any one or a combination of clauses U-Z recites, wherein the cylindrical-shaped retention portion comprises metal, plastic, ceramic, or composite.

AB. A method as any one or a combination of clauses U-AA recites, wherein the first material and/or the second material comprises an elastomer.

AC. A method as any one or a combination of clauses U-AB recites, wherein the first material and/or the second material comprises polyurethane.

AD. A method as any one or a combination of clauses U-AD recites, wherein the first material and/or the second material comprises natural rubber.

A system comprising means for performing any one or a combination of any of clauses N-AD AE. A method comprising: obtaining a stiffening member formed of a first material; overmolding onto the stiffening member formed of the first material, a deformable member formed of a second material.

AF. A method as clause AE recites, wherein the stiffening member formed of the first material comprises: a hollow cylinder having a top opposite a bottom; a wall arranged between the top and the bottom; and one or more apertures arranged in the wall, wherein when at least a portion of a pipe of a drill is slideably displaced through the deformable member, the second material of the deformable member is displaceable by the portion of the pipe of the drill through the one or more apertures of the stiffening member.

AG. A method as any one or a combination of clauses AE-AF recites, further comprising arranging the stiffening member formed of the first material with a cylindrical-shaped retention portion prior to overmolding the deformable member formed of the second material.

AH. A method as any one or a combination of clauses AE-AG recites, further comprising overmolding onto the stiffening member formed of the first material and onto the cylindrical-shaped retention portion, the deformable member formed of the second material.

AI. A method comprising incorporating a rotary flow control diverter comprising a stripping element assembly into a wellhead and a pipe of a drill. The stripping element assembly comprising a stiffening member formed of a first material and a deformable member formed of a second material, the second material forming the deformable member over-molded onto at least a portion of the stiffening member and having a stiffness less than a stiffness of the first material forming the stiffening member. The stiffening member comprising: a hollow cylinder having a top opposite a bottom; a wall arranged between the top and the bottom; and one or more apertures and/or slits arranged in the wall. The deformable member comprising: a top opposite a bottom; and a sealing face arranged on an inside portion of the bottom of the deformable member for slideably sealing with a pipe of a drill. And, the method further comprising slideably displacing at least a portion of the pipe of the drill through the sealing face of the deformable member, wherein when the portion of the pipe of the drill is slideably displaced through the sealing face of the deformable member, the second material of the deformable member is displaced by the portion of the pipe of the drill through the one or more apertures and/or slits of the stiffening member.

As will be apparent to those skilled in the art, various modifications, adaptations and variations of the foregoing specific disclosure can be made without departing from the scope of the invention claimed herein.

What is claimed is:

1. A stripping element assembly comprising:

a non-elastomeric retention portion configured for coupling the stripping element assembly to a rotary flow control diverter;

a stiffening member formed of a first material, the stiffening member comprising:

a top opposite a bottom;

a wall arranged between the top and the bottom;

multiple apertures and/or slits arranged around a circumference of the wall; and a deformable member formed of a second material, wherein the second material is over-molded onto at least a portion of the stiffening member and at least a portion of the retention portion, and wherein the deformable member has a stiffness less than a stiffness of the first material forming the stiffening member, the deformable member comprising:

a sealing surface arranged on an inside circumference of the deformable member for slideably sealing with a pipe of a drill; and wherein when at least a portion of the pipe of the drill is slideably displaced through the sealing surface of the deformable member, the second material of the deformable member is displaced by the portion of the pipe of the drill through the multiple apertures and/or slits of the stiffening member.

2. A stripping element assembly as claim 1 recites, wherein at least one of the multiple apertures and/or slits arranged around the circumference of the wall are formed in a lower end of the stiffening member and extend through the bottom of the stiffening member.

3. A stripping element assembly as claim 1 recites, wherein the multiple apertures and/or slits are arranged uniformly around the circumference of the wall of the stiffening member.

4. A stripping element assembly as claim 1 recites, further comprising multiple members arranged around the circumference of the wall of the stiffening member, the multiple members arranged between the multiple apertures and/or slits, and wherein when at least a portion of the pipe of the drill is slideably displaced through the sealing surface of the deformable member, the multiple members are displaced in a direction away from the pipe of the drill.

5. A stripping element assembly as claim 4 recites, further comprising at least one aperture arranged in at least one of the multiple members, and wherein when at least a portion of the pipe of the drill is slideably displaced through the sealing surface of the deformable member, the second material of the deformable member is displaced by the portion of the pipe of the drill through the at least one aperture arranged in the at least one of the multiple members.

6. A stripping element assembly as claim 1 recites, wherein the retention portion comprises metal, plastic, ceramic, or composite.

7. A stripping element assembly as claim 1 recites, wherein the first material and/or the second material comprises an elastomer.

8. A stripping element assembly as claim 1 recites, wherein the first material and/or the second material comprises polyurethane.

9. A stripping element assembly as claim 1 recites, wherein the first material and/or the second material comprises natural rubber.

10. A method of forming a stripping element assembly, the method comprising:

obtaining a non-elastomeric retention portion configured for coupling the stripping element assembly to a rotary flow control diverter;

obtaining a stiffening member formed of a first material, wherein the stiffening member comprises:

a top opposite a bottom;

a wall arranged between the top and the bottom; and one or more apertures and/or slits arranged in the wall, wherein when at least a portion of a pipe of a drill is slideably displaced through the deformable member, the second material of the deformable member is displaceable by the portion of the pipe of the drill through the one or more apertures and/or slits of the stiffening member; and overmolding onto the retention portion and onto the stiffening member, a deformable member formed of a second material.

* * * * *